US010074115B1

(12) United States Patent
Hynoski et al.

(10) Patent No.: US 10,074,115 B1
(45) Date of Patent: Sep. 11, 2018

(54) SUBSCRIPTION MANAGEMENT SERVICE

(71) Applicant: Amazon Technologies, Inc., Seattle, WA (US)

(72) Inventors: Jeremy Stephen Hynoski, Seattle, WA (US); Eugene Chang, Seattle, WA (US); Andygibb Halim, Redmond, WA (US); Hector Cura, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 720 days.

(21) Appl. No.: 13/966,550

(22) Filed: Aug. 14, 2013

(51) Int. Cl.
*G06Q 30/04* (2012.01)

(52) U.S. Cl.
CPC ..... *G06Q 30/04* (2013.01)

(58) Field of Classification Search
None
See application file for complete search history.

(56) References Cited

U.S. PATENT DOCUMENTS

| | | | | |
|---|---|---|---|---|
| 7,552,446 | B1 * | 6/2009 | Sosnovsky | G06F 1/14 713/501 |
| 2005/0097619 | A1 * | 5/2005 | Haddad | H04N 7/17318 725/115 |
| 2006/0008256 | A1 | 1/2006 | Khedouri et al. | |
| 2006/0010075 | A1 | 1/2006 | Wolf | |
| 2006/0020547 | A1 * | 1/2006 | Lipsanen | H04N 7/17336 705/51 |
| 2007/0038567 | A1 * | 2/2007 | Allaire | G06Q 30/0239 705/50 |
| 2008/0034231 | A1 | 2/2008 | Ginter et al. | |
| 2011/0225417 | A1 | 9/2011 | Maharajh et al. | |

OTHER PUBLICATIONS

Office Action for U.S. Appl. No. 13/966,491, dated Aug. 10, 2016, Heremy Stephen Hynoski, "Subscription Management Service", 17 pages.
Office Action for U.S. Appl. No. 13/966,491, dated Feb. 27, 2017, Heremy Stephen Hynoski, "Subscription Management Service", 24 pages.
Office Action for U.S. Appl. No. 13/966,491, dated Dec. 22, 2017, Heremy Stephen Hynoski, "Subscription Management Service", 24 pages.

* cited by examiner

*Primary Examiner* — Paul Danneman
(74) *Attorney, Agent, or Firm* — Lee & Hayes, PLLC

(57) ABSTRACT

A subscription management service utilizes a timer service to maintain timers corresponding to subscription events. The subscription management service exposes an interface through which clients can define new subscriptions that are then created and managed by the subscription management service. The subscription management service can charge subscribers on an appropriate billing period, and cancel or automatically renew subscriptions at the end of a contract period. The subscription management service can also provide notifications to clients, to subscribers, and/or to other components. The subscription management service might also perform other types of actions with regard to the subscriptions on behalf of the clients. The timer service receives payloads from clients, such as the subscription management service, and provides the payloads back to the clients at a specified time. The timer service might also utilize a jitter threshold to compute the time at which payloads should be provided to clients.

20 Claims, 11 Drawing Sheets

SUBSCRIPTION MANAGEMENT SERVICE

BACKGROUND

Subscriptions are contracts through which a subscriber can receive a material benefit over the course of time. For instance, a subscriber might sign up for a subscription through which they are to receive the benefit of physical items like magazines or newspapers. A subscriber might similarly subscribe to receive the benefit of digital items, like digital audio or video files. Other types of physical and digital items, services, and other types of benefits might also be provided to subscribers through different types of subscriptions.

For a fee, or even no fee in certain types of subscriptions, the subscriber is provided access to the material benefit over the course of time. For example, a customer might subscribe to receive access to a library of digital audio or video files. The contract term for the subscription might be for one month or for a longer period of time, such as one year. The customer might also be billed according to a billing period that is different from the contract period. For example, the contract term of a subscription might be one year, while the billing period is monthly. A subscription will typically stay in effect until the end of the contract period, so long as the customer pays the agreed-upon fee at the end of each billing period. In some cases, a subscription might be automatically renewed at the end of the contract period. Other types of subscriptions and subscription periods might also be utilized.

Managing subscriptions, such as those described above, can be very difficult. In particular, it may be difficult for a merchant to keep track of the various contract and billing periods for large numbers of subscribers, to ensure that the subscribers are billed on time and for the proper amounts, and to ensure that subscriptions expire or are automatically renewed appropriately. Subscription management might be especially difficult for large merchants that have very large numbers of customers, and that offer subscriptions for many types of products or services, each of which might have its own contract, billing, renewal, and potentially other subscription terms.

It is with respect to these and other considerations that the disclosure made herein is presented.

DETAILED DESCRIPTION

Figure 1:
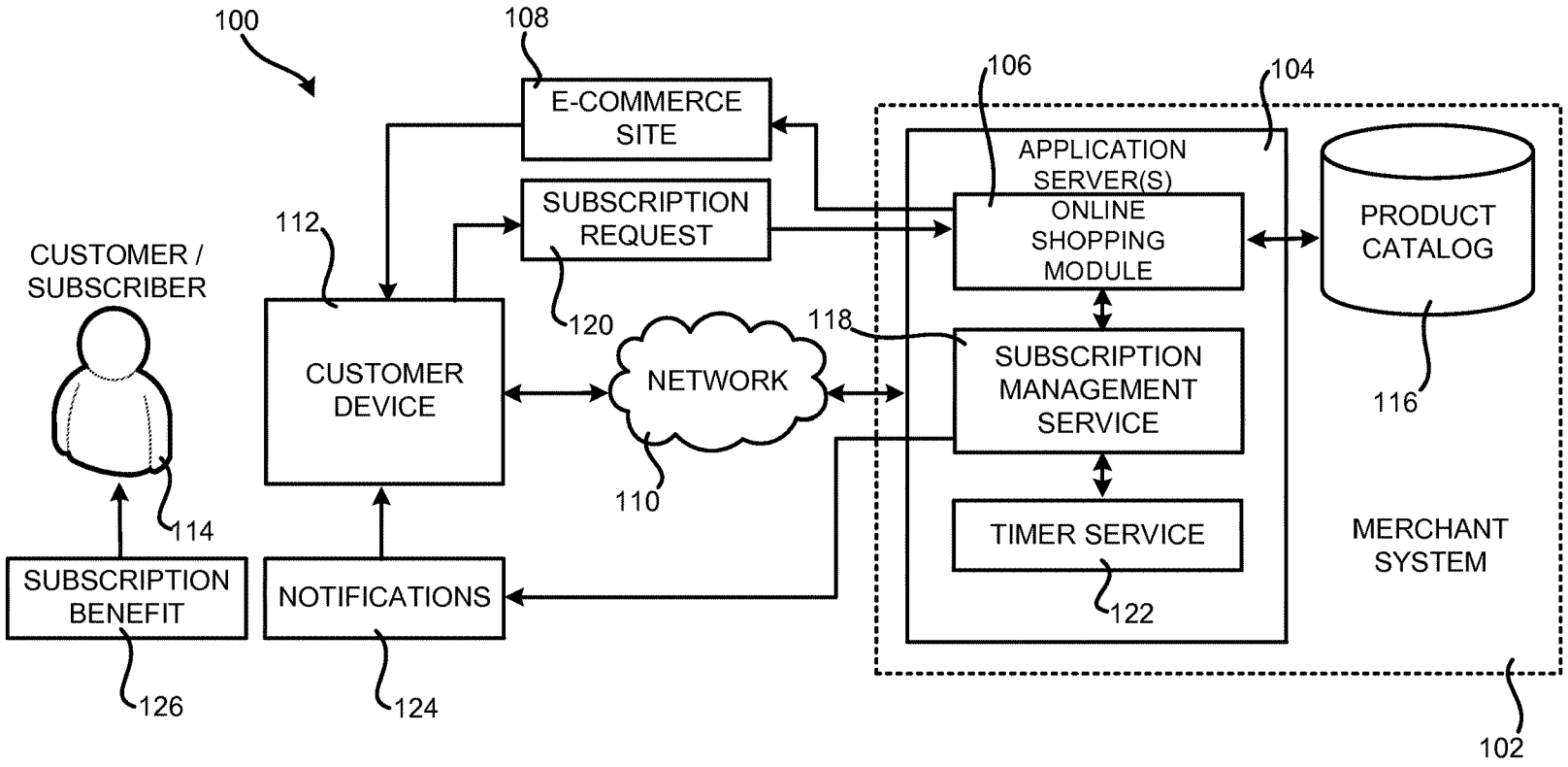
FIG. 1 is a system diagram showing an illustrative configuration for a merchant system that is configured with a subscription management service for managing subscriptions, according to one embodiment disclosed herein.

The following detailed description is directed to technologies for implementing a subscription management service. Through an implementation of the technologies disclosed herein, a subscription management service can be operated that provides services to clients for managing subscriptions. Using such a subscription management service, a client can define new subscriptions that are then created and managed by the subscription management service. For example, once a new subscription has been established, the subscription management service can charge subscribers on an appropriate billing period, and cancel or automatically renew subscriptions at the end of a contract period. Other types of actions might also be taken with regard to the subscriptions. Additionally, subscriptions can be managed on a large scale for many subscribers and for many different types of subscriptions, even where the subscriptions have unique attributes and/or requirements.

According to aspects presented herein, a subscription management service is disclosed that is configured to create and manage subscriptions on behalf of clients. The subscription management service might be operated as a part of a merchant system configured to provide e-commerce functionality in some implementations. In other implementations the subscription management service is operated independently of any merchant system or e-commerce provider.

As will be described in greater detail below, the subscription management service might expose an interface, such as a Web services application programming interface ("API"), through which clients can request the creation of subscriptions and manage existing subscriptions. Other types of interfaces might also be provided for accessing the functionality described herein.

In one implementation, a client can instruct the subscription management service to create a new subscription by providing a subscription creation request to the interface. The subscription creation request might include one or more subscription attributes that define various aspects of the new subscription to be created. For example, and without limitation, the subscription attributes might define a contract period for the subscription, a billing period for the subscription, a cost of the subscription that is to be charged each billing period, data indicating whether the subscription is to be automatically renewed at the end of each contract period, and a subscription benefit identifier that identifies the subscription benefit associated with the subscription.

In some embodiments, the subscription attributes also identify time periods to be utilized when retrying a subscriber's payment instrument following a "soft decline." For example, the attributes might define the number of times the payment instrument should be retried and the number of days or other time periods between retries. The subscription attributes might also specify the number of days, or other time period, after which a subscription should be canceled if the subscriber's payment instrument cannot be charged. Other types of subscription attributes might also be provided in other embodiments. As will be described in greater detail below, the subscription management service might utilize the subscription attributes to perform various types of actions with regard to a subscription.

In response to receiving a request to create a new subscription, the subscription management service utilizes a distributed timer service in one implementation to create timers corresponding to subscription events associated with the new subscription. For example, and without limitation, the subscription management service may create a timer corresponding to the end of the contract period for the subscription. Similarly, the subscription management service might create a timer corresponding to the expiration of one or more billing periods for the subscription. Other types of subscription events for which the subscription management service may create timers include, but are not limited to, a timer corresponding to the end of a grace period following the expiration of a subscriber's payment instrument, a timer corresponding to some period of time before the expiration of a contract period or a billing period, and a timer for tracking an expiration corresponding to a "paused" subscription. Other timers for other types of subscription events might also be created.

As will be described in greater detail, the subscription management service might take various actions with regard to the subscription when the timers described above expire. It should be appreciated that the subscription management service 118 might utilize various types of timer services in different embodiments. For example, and without limitation, the subscription management service might utilize the "cron" time-based job scheduler when implemented in conjunction with a Unix or Unix-like operating system. Other timing mechanism might also be utilized in other embodiments.

In one implementation, the timer service is configured to provide a notification to the subscription management service each time a timer expires. For instance, in one implementation, the subscription management service provides a payload and a time that a timer should expire to the timer service along with a request to create a new timer. The payload might include data identifying a particular subscription event, for instance. When the specified time arrives, the timer service places the payload in a destination specified by the subscription management service. For example, the timer service may place the payload on a distributed queue that is accessible to the subscription management service. This process may be referred to herein as the "firing" of a timer. The subscription management service can then dequeue the payload and utilize the contents of the payload to determine the type of action that is to be taken with regard to the subscription. Additional details regarding the configuration and use of the timer service will be provided below.

In one specific example, the subscription management service might receive a notification from the timer service indicating that the billing period for a subscription has expired, or is about to expire. In this example, the subscription management service might cause a payment instrument associated with the subscription to be charged for the cost of the subscription. In another example, the subscription management service might receive a notification from the timer service indicating that the contract period for a subscription has expired, or is about to expire. In this example, the subscription management service might renew the subscription based on subscription attributes indicating whether the subscription is to be automatically renewed.

The subscription management service or another related component might also provide various notifications to the client regarding the status of a subscription and/or actions taken with regard to the subscription. Similarly, the subscription management service or another related component might also provide various notifications to the subscriber. For example, the subscription management service might provide e-mail or other types of notifications to a subscriber welcoming them to a new subscription, indicating that their payment instrument has been charged at the end of each billing period, and/or indicating that their subscription has been automatically renewed or has expired. The subscription management service might also provide other types of notifications to other recipients, such components within a merchant system. For example, the subscription management service might provide notifications regarding billing a customer for a subscription to a billing and refund service within a merchant system.

The subscription management service might also provide information to clients indicating whether each subscription is in good standing or not. A subscription may be considered to be in good standing if the subscription is active and paid up. A subscription may not be in good standing if an associated payment instrument could not be charged, or for potentially other reasons. The client may then utilize this information to determine whether the benefit of the subscription should be provided to the subscriber.

As discussed briefly above, the subscription management service utilizes a timer service in some embodiments to manage subscription events. In particular, and as also mentioned briefly above, the subscription management service may utilize the timer service to create timers that correspond to subscription events. When the timers expire, the timer service may create notifications to the subscription management service for the subscription events. The subscription management service may then take various types of actions depending upon the type of subscription event identified by the expired timer.

In order to provide the functionality described above, the timer service is configured in one implementation to maintain a client configuration record for each client, such as the subscription management service. The client configuration record stores configuration parameters that are utilized when the timer service processes timer creation requests from a client. For example, the client configuration record might specify a payload destination for the payloads of timers set by the client. The client configuration record might also specify a jitter threshold, which is described below, for use in modifying the time at which timers set by the client should expire. The client configuration record might also include other data such as, but not limited to, a client identifier ("ID") uniquely identifying each client, data describing the type of the payload destination, and a maximum period of time in the future that a timer can be created for the client. The use of this data will be described in detail below.

It should be appreciated that the jitter threshold might also be specified in other ways, such as within a request to create a new subscription. It should also be appreciated that the jitter threshold might be computed by the timer service in some embodiments rather than specified by a client of the timer service. For example, machine learning and/or other techniques might be utilized to compute a jitter threshold for a particular client. The jitter threshold might be computed based upon the frequency of incoming timer creation requests from the client, based upon the load on the timer service, and/or other factors. A client might also be permitted to specify a jitter threshold or request that the timer service compute and utilize an appropriate jitter threshold on behalf of the client. The timer service might also modify a jitter threshold specified by a client in a similar manner.

The timer service might also expose an interface, such as a Web services API, through which clients can submit requests to create new timers and/or modify existing timers. Clients, such as the subscription management service, may utilize the interface to create new timers and/or modify existing timers. For example, a client may transmit a request to create a new timer to the interface along with a payload for the timer. The payload may include arbitrary data specified by the client. In the case of the subscription management service, for example, the payload might specify details regarding a subscription event for future consumption by the subscription management service. The new timer request also specifies a time at which the specified payload is to be provided to the payload destination specified in the client configuration record for the calling client.

In some implementations, the timer service utilizes the jitter threshold specified by the client to modify the time at which the payload will be provided to the specified destination. The jitter threshold specifies a maximum amount of time after the time specified in the timer creation request that the payload can be provided to the payload destination. The timer service may modify the time specified in the timer creation request by selecting a random amount of time less than the jitter threshold, and adding the random amount of time to the time specified in the timer creation request. The requested time as modified by the jitter threshold is referred to herein as the "scheduled time" for the timer. The scheduled time is then used as the time at which the payload should be provided to the specified destination. The jitter threshold can be utilized in this manner to help ensure that large numbers of timers do not expire at exactly the same time, while still meeting any timeliness requirements of the client.

Once the scheduled time for a new timer request has been computed using the jitter threshold, the timer service creates the new timer using the scheduled time and the specified payload. In some implementations, a timer record is created that specifies the scheduled time and includes the payload. The timer record might also include other data, such as the unique client ID mentioned above. The timer record may be stored on at least two nodes in a database cluster in some implementations.

The timer service periodically evaluates the timer records stored on the nodes of the database cluster. The timer service then provides the payload of each timer record to the specified destination endpoint at, or approximately at, the time specified by the timer records. For example, and as described briefly above, the timer service might place the payload of a timer record on a distributed queue for consumption by the proper client that created the timer, such as the subscription management service. Additional details regarding these and other aspects of the embodiments disclosed herein will be provided below with regard to FIGS. 1-12.

It should be appreciated that the embodiments disclosed herein might be utilized with any type of computer, computing system, device, merchant site, application program, operating system, or other type of system or component. Accordingly, although the embodiments disclosed herein are primarily presented in the context of a merchant system that embodies the concepts disclosed herein for providing subscription management services, the disclosure presented herein is not limited to such an implementation. For example, the concepts disclosed herein might be used to provide subscription management services independently of a merchant system. The concepts disclosed herein might also be utilized to provide timer services to clients independently of a merchant system and/or a subscription management service. Other configurations might also be utilized.

It should be also appreciated that the subject matter presented herein may be implemented as a computer process, a computer-controlled apparatus, a computing system, or an article of manufacture, such as a computer-readable storage medium. These and various other features will become apparent from a reading of the following disclosure and a review of the associated drawings.

While the subject matter described herein is presented in the general context of program modules that execute on one or more computing devices, those skilled in the art will recognize that other implementations may be performed in combination with other types of program modules. Generally, program modules include routines, programs, components, data structures, and other types of structures that perform particular tasks or implement particular abstract data types.

Those skilled in the art will appreciate that the subject matter described herein may be practiced on or in conjunction with other computer system configurations beyond those described below, including multiprocessor systems, microprocessor-based or programmable consumer electronics, minicomputers, mainframe computers, handheld computers, personal digital assistants, tablet computers, electronic book readers, wireless telephone devices, special-purposed hardware devices, network appliances, or the like. The embodiments described herein may also be practiced in distributed computing environments, where tasks are performed by remote processing devices that are linked through a communications network. In a distributed computing environment, program modules may be located in both local and remote memory storage devices.

In the following detailed description, references are made to the accompanying drawings that form a part hereof, and that show, by way of illustration, specific embodiments or examples. The drawings herein are not drawn to scale. Like numerals represent like elements throughout the several figures.

FIG. 1 and the following description are intended to provide a brief, general description of a suitable computing environment in which the embodiments described herein may be implemented. In particular, FIG. 1 is a system diagram showing an operating environment 100 that includes a merchant system 102 that is configured with a subscription management service 118 for managing subscriptions on behalf of clients, according to one embodiment disclosed herein. The environment 100 is merely illustrative and the embodiments disclosed herein might be utilized in many different types of environments.

The environment 100 includes a merchant system 102 that is configured to provide the functionality disclosed herein. In order to provide this functionality, the merchant system 102 is configured with one or more application servers 104. The application servers 104 may execute a number of modules in order to provide the functionality disclosed herein. The modules may execute on a single application server 104 or in parallel across multiple application servers in the merchant system 102. In addition, each module may consist of a number of subcomponents executing on different application servers 104 or other computing devices in the merchant system 102. The various program modules disclosed herein may be implemented as software, hardware, or any combination of the two.

According to one embodiment, an online shopping module 106 executes on the application servers 104. The online shopping module 106 provides functionality for allowing customers of the merchant system 102, such as the customer 114, to browse, search, and purchase products available from the online merchant that operates the merchant system 102. For instance, the online shopping module 106 may provide an e-commerce site 108 through which a customer 114 (who also may be referred to herein as a "subscriber 114") might rent or purchase various physical and digital goods.

In order to provide the e-commerce site 108, the online shopping module 106 might retrieve information regarding a particular product offered for rent or sale by the online merchant from a product catalog 116, generate a product page containing product information, and transmit the product page over a network 110 to a client application executing on a customer device 112. Example customer devices include, but are not limited to, smartphones, tablet computing devices ("tablets"), electronic book readers ("e-readers"), and laptop or desktop computers ("computers"). Other types of devices might also be utilized to access the functionality disclosed herein as being provided by the merchant system 102.

In order to generate the e-commerce site 108, the online shopping module 106 might utilize various pre-defined and stored resources, such as Web pages, images, text files, program code for generating Web pages, metadata, scripts, executable code, and other types of data utilized to create and/or provide a Web page. The online shopping module 106 might also generate Web pages and other resources dynamically at the time pages in the e-commerce site 108 are requested using information stored in the product catalog 116. The product records in the product catalog might include various types of information for the products available for purchase or rental, including but not limited to, a unique product identifier, a product description, a product category, the number of units of the product in stock, and, potentially, other information.

Users of the merchant system 102, such as the customer 114, may access the merchant system 102 through the network 110. The network 110 may be a local-area network ("LAN"), a wide-area network ("WAN"), the Internet, or any other networking topology known in the art that connects customer devices 112 to the merchant system 102. Customers may use a client application (not shown) executing on their respective customer device 112 to access and utilize the services provided by the application servers 104.

In one embodiment the client application executing on the customer devices 112 is a Web browser application, such as the MOZILLA® FIREFOX® Web browser from MOZILLA FOUNDATION of Mountain View, Calif. The client application exchanges data with the application servers 104 in the merchant system 102 using the hypertext transfer protocol ("HTTP") and/or another appropriate protocol over the network 110. The client application might also be a stand-alone client application configured for communicating with the application servers 104. The client application might also utilize any number of communication methods known in the art to communicate with the merchant system 102 and/or the application servers 104 across the network 110, including remote procedure calls, SOAP-based Web services, remote file access, proprietary client-server architectures, and the like.

In one embodiment, the merchant system 102 is also configured to permit customers 114 to subscribe to receive the benefit of certain goods and/or services. As discussed above, a subscription is a contract through which a subscriber 114 can receive a subscription benefit 126 over the course of time. For example, the merchant system 102 might permit a subscriber 114 to subscribe to receive scheduled delivery of physical items. The merchant system 102 might also permit a subscriber 114 to subscribe to receive digital audio and/or video content provided by the merchant system 102 on an ongoing basis. The merchant system 102 might also allow subscribers 114 to subscribe for free or reduced cost shipping for items purchased from the merchant system 102. The merchant system 102 might also allow subscribers to subscribe to receive other types of physical and digital items and/or services.

Subscriptions typically have various associated periods. For example, subscriptions will typically have a contract period that defines the length of the subscription contract. The contract period for a subscription might be for virtually any period of time, such as one month or a longer period of time, such as one year. Subscriptions also typically have an associated billing period. A payment instrument (e.g. a credit card) associated with the subscriber 114 is billed according to the billing period. The billing period may be the same as or different from the contract period. For example, the contract period of a subscription might be one year, while the billing period may be monthly. A subscription will typically stay in effect until the end of the contract period, so long as the subscriber 114 pays the agreed-upon subscription fee at the end of each billing period. In some cases, a subscription might be automatically renewed at the end of the contract period. Other types of subscriptions and subscription periods might also be utilized.

As discussed above, managing subscriptions can be difficult for a variety of reasons. In particular, it may be difficult for a merchant to keep track of the various contract and billing periods for large numbers of subscribers 114, to ensure that the subscribers 114 are billed on time and for the proper amounts, and to ensure that subscriptions expire or are automatically renewed appropriately. Subscription management might be especially difficult for large merchants that have very large numbers of subscribers 114, and that offer subscriptions for many types of products and/or services, each of which might have its own contract period, billing period, renewal terms, and other attributes.

In order to address the considerations described above, and potentially others, the merchant system 102 is configured in one embodiment with a subscription management service 118. As will be described in greater detail herein, the subscription management service 118 provides subscription management functionality to clients, such as the online shopping module 106. Although not illustrated in FIG. 1, the subscription management service 118 might provide its functionality to other clients within and, potentially, external to the merchant system 102. As also mentioned above, in some implementations, the subscription management service 118 operates independently of the merchant system 102 to provide its functionality to clients. Other configurations might also be utilized.

Using the subscription management service 118, a client can define new subscriptions that are then created and managed by the subscription management service 118. For example, once a new subscription has been established, the subscription management service 118 can charge subscribers 114 according to a client-specified billing period, and cancel or automatically renew subscriptions at the end of a client-specified contract period. The subscription management service 118 can also provide notifications to the clients and the subscribers 114. The subscription management service 118 might also take other types of actions with regard to the subscriptions. Additionally, the subscription management service 118 can be configured to manage subscriptions on a large scale for many clients, even where the subscriptions have unique attributes and/or requirements. Additional details regarding these aspects will be provided below.

The functionality provided by the subscription management service 118 is typically initiated when a customer 114 signs up for a new subscription through a client of the subscription management service 118. For example, the customer 114 might utilize functionality provided by the e-commerce site 108 to submit a subscription request 120 to the online shopping module 106. As mentioned above, the subscription request 120 might request that the customer 114 be subscribed to the periodic delivery of physical goods, to a digital audio and/or video service provided by the merchant system 102, and/or to various other types of services, such as free or reduced fee shipping for items purchased through the merchant system 102.

In response to receiving the subscription request 120, the online shopping module 106 is configured to utilize the subscription management service 118 to manage various aspects of the new subscription. In this regard, the subscription management service 118 might expose an interface, such as a Web services API, through which clients can request the creation of subscriptions and manage existing subscriptions. The subscription management service 118 might also expose other types of for accessing its functionality.

Once a client, such as the online shopping module 106, has requested the creation of a new subscription, the subscription management service 118 creates the new subscription and manages events associated with the lifecycle of the subscription. For example, and as discussed briefly above, the subscription management service 118 might charge the subscriber 114 on an appropriate billing period, and/or cancel or automatically renew the subscription at the end of a contract period. The subscription management service 118 might also transmit notifications to a customer device 112 associated with a subscriber 114. For instance, the subscription management service 118 might provide e-mail or other types of notifications to a subscriber 114 welcoming them to a new subscription, indicating that their payment instrument has been charged at the end of each billing period, and/or indicating that their subscription has been automatically renewed or has expired. The subscription management service might also provide other types of notifications to the client and, potentially, other components within and/or external to the merchant system 102.

In order to provide the functionality described above, the subscription management service 118 is configured to utilize a timer service 122 in one embodiment. As will be described in greater detail below, the timer service 122 is a distributed service that provides functionality for the creation of timers. The timer service 122 also provides notifications when the timers expire. The subscription management service 118 utilizes the timer service 122 in one implementation to create timers corresponding to subscription events associated with each subscription. For example, and without limitation, the subscription management service 118 may utilize the timer service 122 to create a timer corresponding to the end of the contract period for a subscription. Similarly, the subscription management service 118 might create a timer corresponding to the expiration of one or more billing periods for a subscription. As will be described in greater detail, the subscription management service 118 might take various actions with regard to a subscription when these timers expire.

The subscription management service 118 might also provide information to clients indicating whether each subscription is in good standing or not. A subscription may be considered to be in good standing if the subscription is active and paid up. A subscription may not be in good standing if an associated payment instrument could not be charged, or for potentially other reasons. Each client may then utilize this information to determine whether the subscription benefit 126 should be provided to the subscriber 114. Additional details regarding the configuration and operation of the subscription management service 118 will be provided below with regard to FIGS. 2-5. Additional details regarding the configuration and operation of the timer service 122 will be provided below with regard to FIGS. 6-11.

Figure 2:
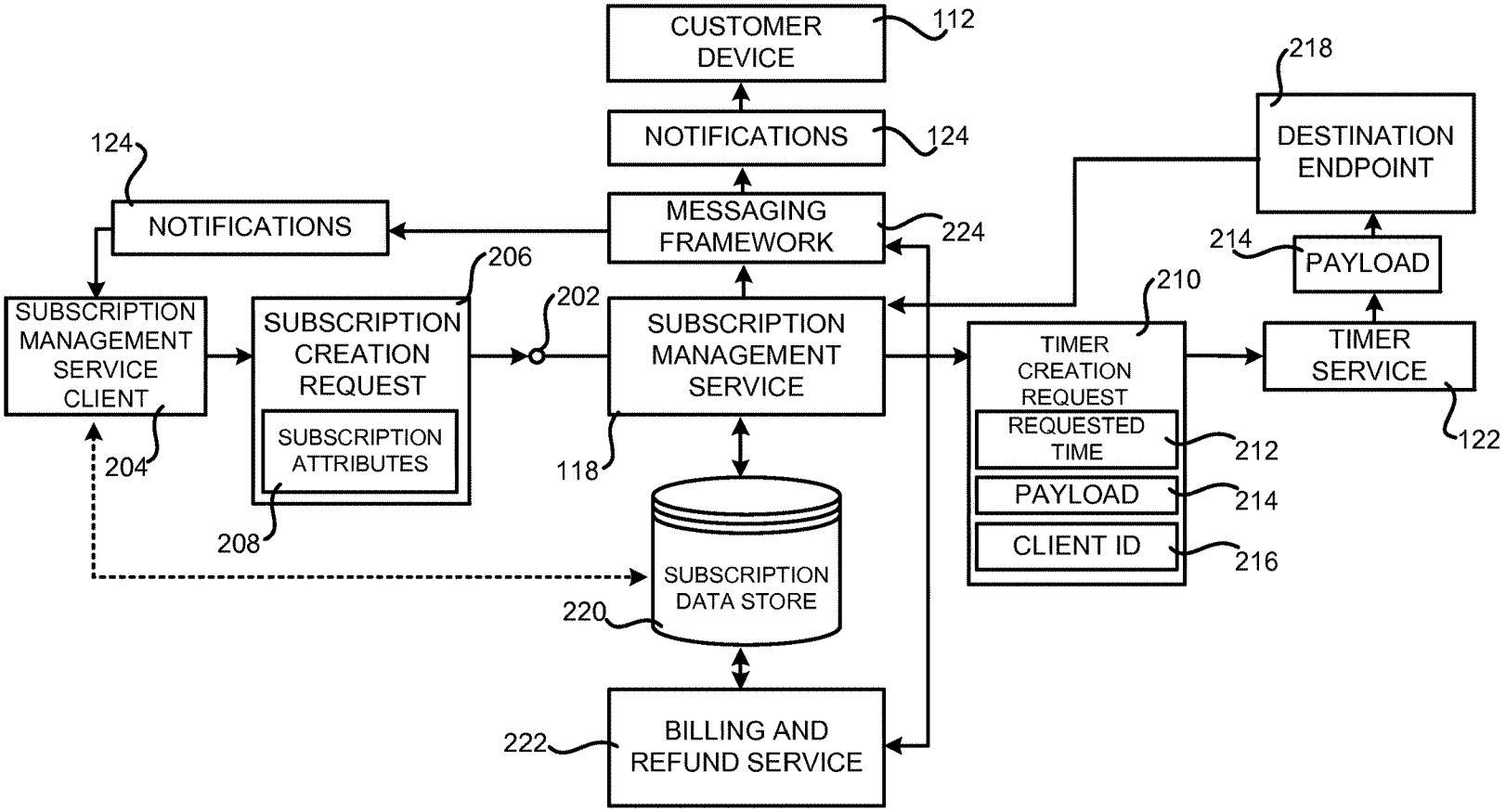
FIG. 2 is a software architecture diagram showing aspects of the configuration of a subscription management service, according to one embodiment disclosed herein.

FIG. 2 is a software architecture diagram showing additional aspects of the configuration and operation of the subscription management service 118 and several associated components, according to one embodiment disclosed herein. As shown in FIG. 2, and described briefly above, the subscription management service 118 exposes an interface 202 through which subscription management service clients 204 (which may be referred to herein simply as "clients" or a "client") can create and manage subscriptions. The interface 202 may be a Web services API, another type of API, or another type of interface altogether.

As also shown in FIG. 2, a client 204 can submit a subscription creation request 206 to the interface 202 in order to request that the subscription management service 118 create a new subscription. The subscription creation request 206 might include one or more subscription attributes 208 that define various aspects of the new subscription to be created. For example, and without limitation, the subscription attributes 208 might define a contract period for the subscription, a billing period for the subscription, a cost of the subscription that is to be charged each billing period, data indicating whether the subscription is to be automatically renewed at the end of each contract period, and a subscription benefit identifier that identifies the subscription benefit associated with the subscription.

As described briefly above, other types of subscription attributes 208 might also be provided in other embodiments. For example, and without limitation, the subscription attributes 208 might also identify time periods to be utilized when retrying a subscriber's payment instrument following a "soft decline." For example, the attributes 208 might define the number of times a payment instrument should be retried and the number of days or other time periods between retries. The subscription attributes 208 might also specify the number of days, or other time period, after which a subscription should be canceled if the subscriber's payment instrument cannot be charged. As will be described in greater detail below, the subscription management service 118 utilizes the subscription attributes 208 to perform various types of actions with regard to the subscription.

In response to receiving a request to create a new subscription, the subscription management service 118 stores data identifying the new subscription in an appropriate data store, such as the subscription data store 220. The subscription management service 118 might also store data in the subscription data store 220 indicating the current state of each subscription. For example, the subscription management service 118 might store data in the subscription data store 220 indicating whether each subscription is pending approval, active, cancelled, or paused.

The subscription management service 118 might also store additional subscription attributes 208 in the subscription data store 220. For example, and without limitation, the subscription management service 118 might store information identifying a group of individuals associated with each subscription. In various embodiments, each member of a group might be assigned a particular role with respect to the subscription. For example, one role might indicate an owner of a subscription and another role might indicator the payer of a subscription. Other types of roles might be defined. Each role might also be provided different subscription benefits. For example, in the case where one person gifts a subscription to another person, the recipient of the gift might be entitled to receive the benefit of the subscription, while the person that paid for the subscription would not be entitled to the benefit. Other types of data might also be stored in the subscription data store 220.

The subscription management service 118 also utilizes the timer service 122 in one implementation to create timers corresponding to subscription events associated with the new subscription. For example, and without limitation, the subscription management service 118 may create a timer corresponding to the end of the contract period for the subscription. Similarly, the subscription management service 118 might create a timer corresponding to the expiration of one or more billing periods for the subscription. As will be described in greater detail, the subscription management service 118 might take various actions with regard to the subscription when these timers expire.

In order to provide the functionality described above, the timer service 122 might expose an interface, such as a Web services API or another type of interface, through which clients can submit requests to create new timers and/or modify existing timers. Clients of the timer service 122, such as the subscription management service 118, may utilize the interface to create new timers and/or modify existing timers. For example, the subscription management service 118 may transmit a timer creation request 210 to the interface along with a payload 214 for the timer. The payload 214 may include arbitrary data specified by the subscription management service 118. For example, the payload 214 might specify details regarding a subscription event for future consumption by the subscription management service 118. The timer creation request 210 also specifies a time at which the specified payload 214 is to be provided to a destination endpoint 218. The timer creation request 210 might also include a client ID 216 that uniquely identifies the client submitting the timer creation request 210.

Using the information contained in the timer creation request 210, the timer service 122 may create a new timer set to expire at the requested time 212. In some implementations, the timer service 122 utilizes a jitter threshold specified by the requesting client to modify the time 212 at which the payload 214 will be provided to the destination endpoint 218. A jitter threshold can be utilized in this manner to help ensure that large numbers of timers do not expire at exactly the same time, while still meeting any timeliness requirements of the client. Additional details regarding the use of a jitter threshold will be provided below with regard to FIGS. 6-11.

The timer service 122 periodically evaluates each timer and provides the payload 214 of each timer to the specified destination endpoint 218 at, or approximately at, the time 212 specified by the timer. For example, and as described briefly above, the timer service 122 might place the payload 214 for a timer on a distributed queue for consumption by the proper client, such as the subscription management service 118, at the time 212. The subscription management service 118 can then dequeue the payload 214 and utilize the contents of the payload 214 to determine the type of action that is to be taken with regard to the subscription.

For example, the subscription management service 122 might receive a payload 214 indicating that the billing period for a subscription has expired, or is about to expire. In this example, the subscription management service 122 might instruct the billing and refund service 222 to charge a payment instrument associated with the subscription for the cost of the subscription as specified by the subscription attributes 208. In another example, the subscription management service 118 might receive a payload 214 from the timer service 122 indicating that the contract period for a subscription has expired, or is about to expire. In this example, the subscription management service 122 might renew the subscription based on subscription attributes 208 indicating whether the subscription is to be automatically renewed. The subscription management service 122 might also utilize the timer service 122 to set timers corresponding to other types of subscription events and take other types of actions based on the expiration of these timers.

The subscription management service 122 might also utilize a messaging framework 224 to provide notifications 124 to the client 204 regarding the status of a subscription and/or actions taken with regard to the subscription. Similarly, the subscription management service 118 might utilize the messaging framework 224 to provide notifications 124 to a customer device 112 associated with a subscriber 114. For example, and as mentioned briefly above, the subscription management service 118 might provide e-mail or other types of notifications to a subscriber 114 welcoming them to a new subscription, indicating that their payment instrument has been charged at the end of each billing period, and/or indicating that their subscription has been automatically renewed or has expired. In some embodiments, the client 204 can specify the content of the notifications sent to the subscribers 114.

The subscription management service 122 might also utilize the messaging framework 224 to provide other types of notifications to other recipients, such components within the merchant system 102. For example, the subscription management service 122 might utilize the messaging framework 224 to provide notifications regarding billing a customer for a subscription to the billing and refund service 222 operating within the merchant system 102. The subscription management service 118 might also utilize the messaging framework 224 to provide other types of notifications to other components within or external to the merchant system 102.

As discussed briefly above, the subscription management service 118 might also provide information to clients 204 indicating whether each subscription is in good standing or not. For example, data stored in the subscription data store 220 indicating whether each subscription is in good standing may be exposed to the clients 204. A subscription may be considered to be in good standing if the subscription is active and paid up. A subscription may not be in good standing if an associated payment instrument could not be charged, or for potentially other reasons. The clients 204 may then utilize this information to determine whether the subscription benefit 126 should be provided to the subscriber 114. Additional details regarding the operation of the subscription management service 118 will be provided below with regard to FIGS. 3-5. Additional details regarding the configuration and operation of the timer service 122 will be provided below with regard to FIGS. 6-11.

Figure 3:
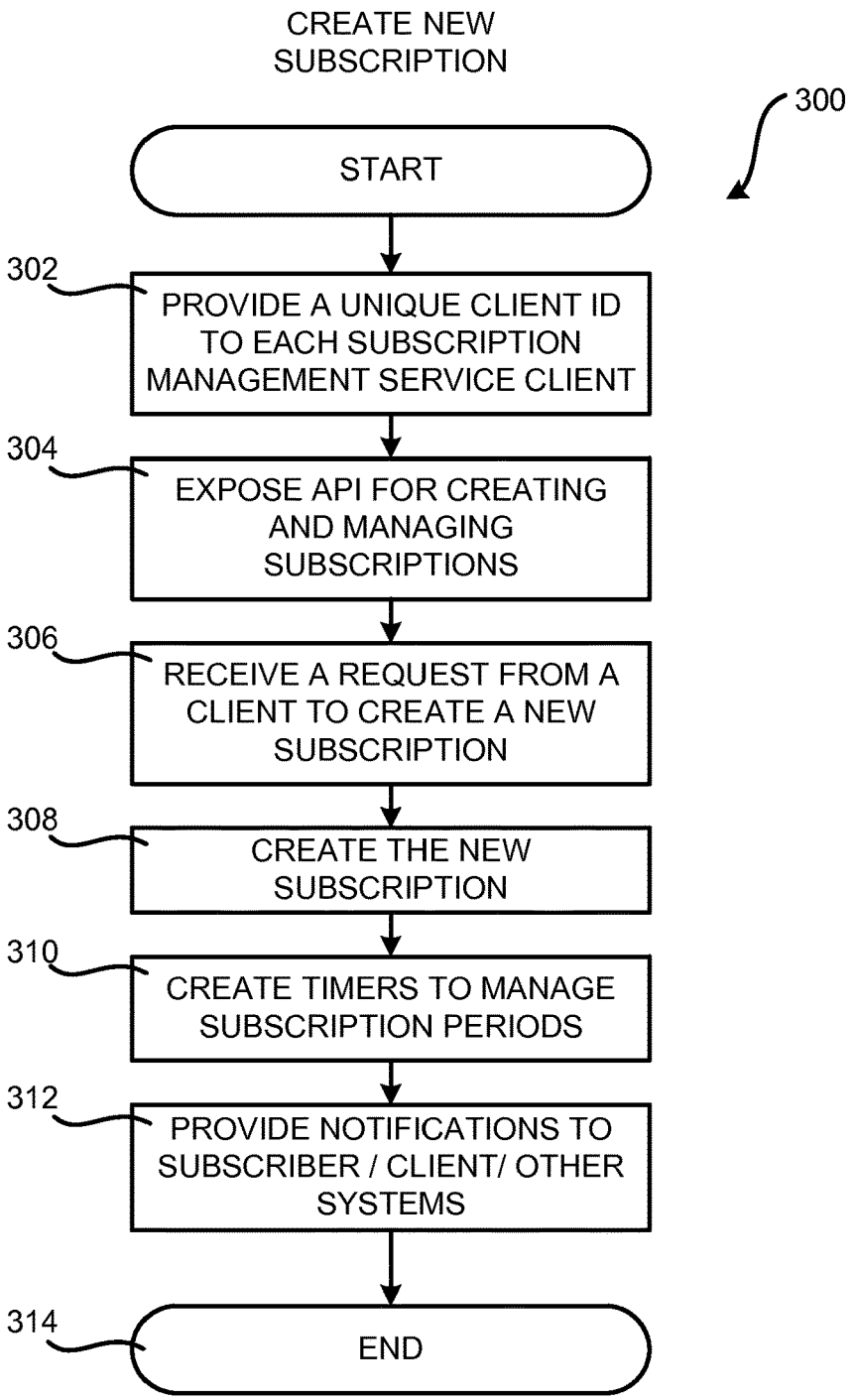
FIG. 3 is a flow diagram showing aspects of the operation of the subscription management service for creating a new subscription, according to one embodiment disclosed herein.

Turning now to FIG. 3, additional details will be provided regarding the operation of the subscription management service 118. In particular, FIG. 3 is a flow diagram showing a routine 300 that illustrates aspects of the operation of the subscription management service 118 for creating a new subscription, according to one embodiment disclosed herein.

It should be appreciated that the logical operations described herein are implemented (1) as a sequence of computer implemented acts or program modules running on a computing system and/or (2) as interconnected machine logic circuits or circuit modules within the computing system. The implementation is a matter of choice dependent on the performance and other requirements of the computing system. Accordingly, the logical operations described herein with reference to the various FIGS. are referred to variously as operations, structural devices, acts, or modules. These operations, structural devices, acts, and modules may be implemented in software, in firmware, in special purpose digital logic, and any combination thereof. It should also be appreciated that more or fewer operations may be performed than shown in the figures and described herein. These operations may also be performed in parallel, or in a different order than those described herein.

The routine 300 begins at operation 302, where the subscription management service 118 assigns a unique client ID to each client 204. The client ID uniquely identifies each client 204, and may be submitted to the subscription management service 118 with requests to create new subscriptions and/or manage existing subscriptions. The client ID might be a unique numeric or alphanumeric identifier. Other types of unique client IDs might also be utilized.

From operation 302, the routine 300 proceeds to operation 304 where the subscription management service 118 exposes an interface 202 through which clients 204 can create and manage subscriptions. As mentioned above, the interface 202 might be a Web services API, another type of API, or another type of interface altogether. From operation 304, the routine 300 proceeds to operation 306.

At operation 306, the subscription management service 118 receives a subscription creation request 206 from a client 204 by way of the interface 202. As mentioned above, the subscription creation request 206 might include one or more subscription attributes 208. For example, the subscription creation request 206 might include subscription attributes 208 defining a contract period for the new subscription, a billing period for the new subscription, a cost of the new subscription that is to be charged each billing period, and/or data indicating whether the new subscription is to be automatically renewed at the end of each contract period. Other types of subscription attributes 208 might also be provided in other embodiments. As will be discussed in greater detail below, the subscription management service 118 may utilize the subscription attributes 208 to perform various actions with regard to the subscription.

From operation 306, the routine 300 proceeds to operation 308, where the subscription management service 118 creates the new subscription. As mentioned above, this might include storing data in the subscription data store 220 for the new subscription, such as the subscription attributes 208 and a status for the new subscription. The subscription management service 118 might also store other types of data in the subscription data store 220, and potentially in other locations, for the new subscription.

From operation 308, the routine 300 proceeds to operation 310 where the subscription management service 118 may utilize the timer service 122 to create one or more timers to manage various subscription periods for the new subscription. For example, and as discussed above, the subscription management service 118 may create timers based upon the subscription attributes 208 that correspond to the contract period, the billing period, and other subscription periods. Additional details regarding the use of the timers will be provided below with regard to FIG. 4.

From operation 310, the routine 300 proceeds to operation 312, where the subscription management service 118 may utilize the messaging framework 224 to provide one or more notifications 124 to the subscriber 114 associated with the new subscription. For example, an e-mail or other type of message may be transmitted to the subscriber 114 welcoming them to the new subscription. The subscription management service 118 might also utilize the messaging framework 224 to provide one or more notifications 124 to the client 204 and/or other systems or components. For example, the subscription management service 118 may utilize the messaging framework 224 to provide one or more notifications 124 to the client 204 confirming that the new subscription has been created. The subscription management service 118 might also utilize the messaging framework 224 to provide one or more notifications 124 to the billing and refund service 222 indicating that a charge should be made to the payment instrument associated with the new subscription. Other types of notifications might also be provided. From operation 312, the routine 300 proceeds to operation 314, where it ends.

Figure 4:
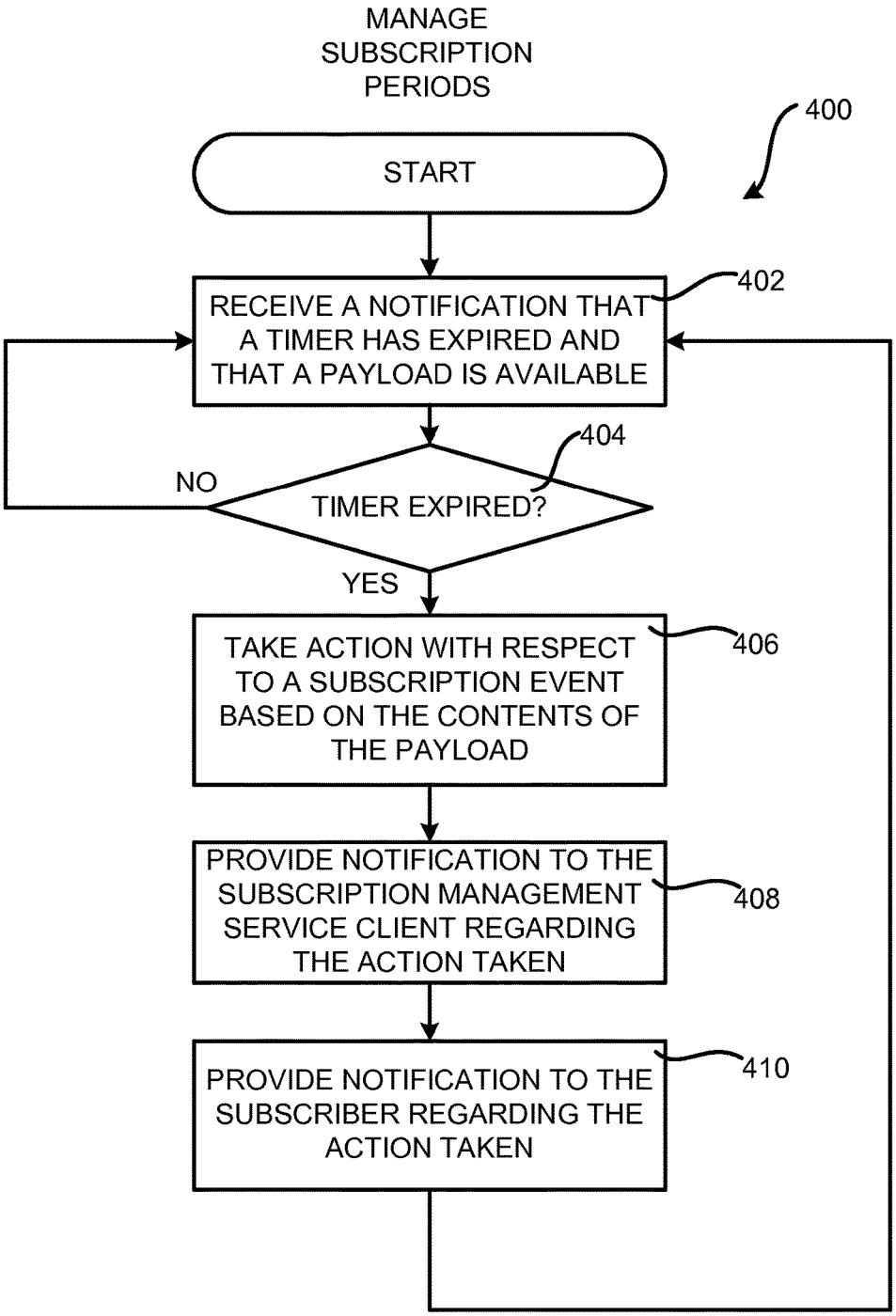
FIG. 4 is a flow diagram showing aspects of the operation of the subscription management service for managing subscription periods, according to one embodiment disclosed herein.

FIG. 4 is a flow diagram showing a routine 400 that illustrates aspects of the operation of the subscription management service 118 for managing subscription periods, according to one embodiment disclosed herein. The routine 400 begins at operation 402, where the subscription management service 118 determines whether a notification has been received that a timer has expired and that an associated payload 214 is available. As mentioned above, the timer service 122 may place the payload 214 for a timer on a destination endpoint 218 at or around the time that the timer expires. For example, in one implementation the destination endpoint 218 is a distributed queue. In this example, the timer service 122 may place the payload 214 of expired timers on the distributed queue for consumption by the subscription management service 118. As will be described in greater detail below, the contents of the payload 214 are utilized to determine a type of action that should be taken with regard to the corresponding subscription.

If the subscription management service 118 determines that a timer has not expired, the routine 400 proceeds from operation 404 to operation 402, where another such determination may be made. If, however, a timer has expired and a payload 214 is available for the subscription management service 118, the routine 400 proceeds from operation 404 to operation 406.

At operation 406, the subscription management service 118 retrieves the payload 214 for the expired timer and takes action with respect to the corresponding subscription based upon the contents of the payload 214. For example, the contents of the payload 214 might indicate that a billing period for a subscription has expired. In this case, the subscription management service 118 might cause a payment instrument associated with the subscription to be charged. In another example, the content of the payload 214 indicates that the contract period for a subscription has expired. In this example, the subscription management service 118 might cause the subscription to be automatically renewed based upon the associated subscription attributes 208. The subscription management service 118 might also take various other types of actions with regard to a subscription based upon the contents of a payload 214 for an expired timer.

From operation 406 the routine 400 proceeds to operation 408, where the subscription management service 118 may provide a notification 124 to the client 204 associated with the subscription indicating the type of action taken at operation 406. For example, the subscription management service 118 might provide a notification 124 to the client 204 indicating that a charge was made for a subscription or that a subscription was renewed or expired. Other types of notifications 124 might also be provided to the client 204 associated with the subscription for which action was taken at operation 406.

From operation 408, the routine 400 proceeds to operation 410, where the subscription management service 118 might also provide a notification 124 to a subscriber 114 regarding the action taken with respect to their subscription. For example, and without limitation, the subscription management service 118 might provide a notification 124 to the subscriber 114 indicating that their payment instrument was charged or that their subscription automatically renewed or expired. As discussed above, the client 204 may be permitted to specify the content contained in such a notification 124. From operation 410, the routine 400 proceeds back to operation 402, described above.

Figure 5:
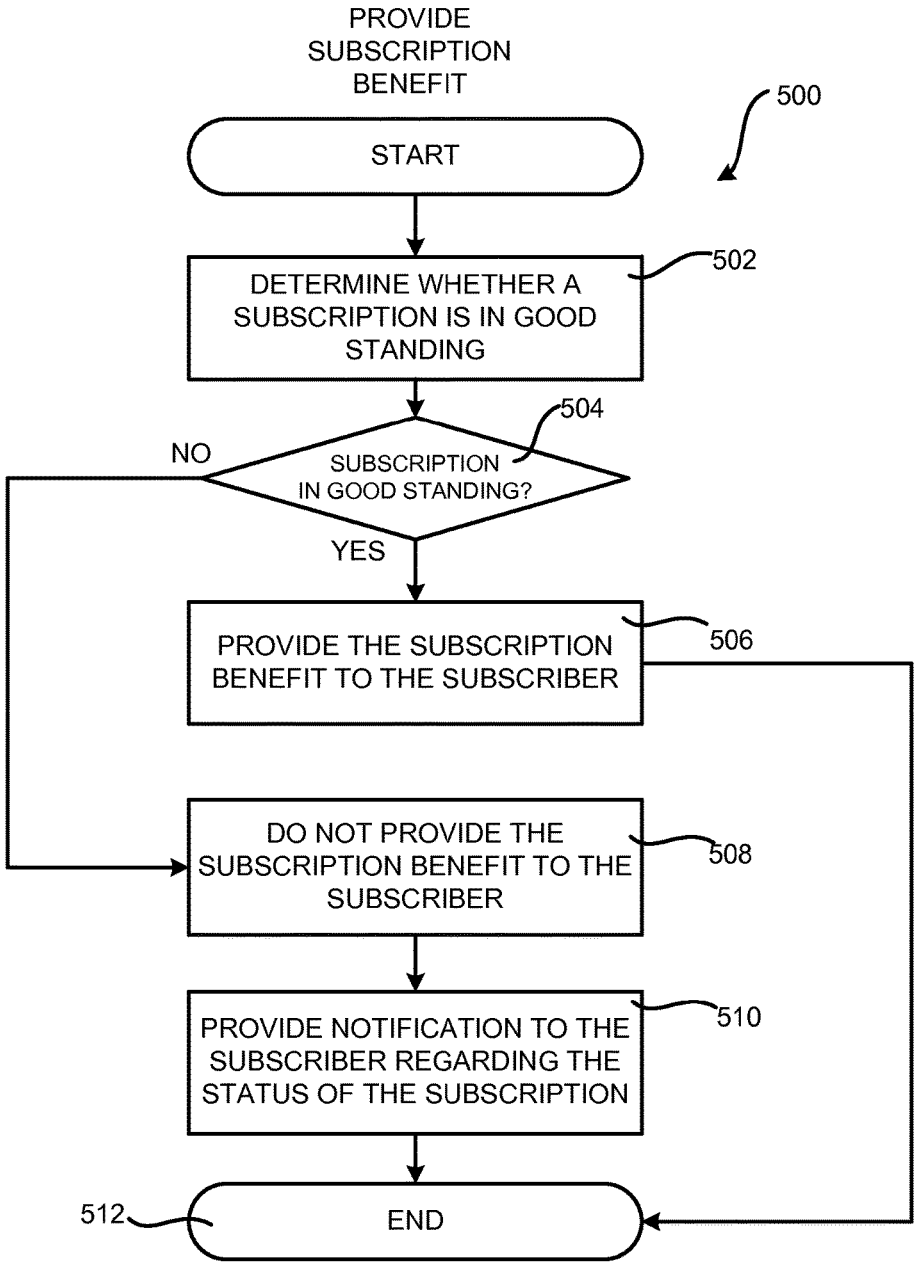
FIG. 5 is a flow diagram showing aspects of the operation of a subscription management service client for providing a subscription benefit to a subscriber, according to one embodiment disclosed herein.

FIG. 5 is a flow diagram showing a routine 500 that illustrates aspects of the operation of the subscription management service client 204 for providing a subscription benefit 126 to a subscriber 114, according to one embodiment disclosed herein. The routine 500 begins at operation 502, where the client 204 determines whether a particular subscription is in good standing. As described above, the subscription management service 118 might expose information to the client 204 regarding the current standing of subscriptions. For example, the subscription management service 118 might expose information stored in the subscription data store 220 that describes the current standing of each subscription to the clients 204. Other mechanisms might also be utilized to provide information to the clients 204 regarding the current standing of subscriptions.

If a subscription is not in good standing, the routine 500 proceeds from operation 504 to operation 508, described below. If, however, the subscription is in good standing, the routine 500 proceeds from operation 504 to operation 506. At operation 506, the client 204 may provide the subscription benefit 126 to the subscriber 114. For example, in the case of a digital audio or video subscription, the client 204 might enable the subscriber 114 to access the digital audio or video content. The routine 500 then proceeds from operation 506 to operation 512, where it ends.

At operation 508, the client 204 denies the subscriber 114 access to the subscription benefit 126. For instance, in the case of a digital audio or video subscription, the client 204 might not allow the subscriber 114 to access the digital audio or video content. It should be appreciated that, in some embodiments, the subscription benefit may be provided to the subscriber for some configurable period of time after the subscription is determined not to be in good standing. For example, a "grace period" might be provided during which the subscription benefit is still provided to the subscriber even after it is determined that a subscriber's credit card is no longer valid. As described above, attempts might be periodically made during this time in an attempt to charge the subscriber's card or otherwise place the subscription in good standing.

The routine 500 then proceeds from operation 508 to operation 510, where the subscription management service 118 and/or the client 204 might utilize the messaging framework 224 to provide a notification 124 to the subscriber 114 regarding the status of their subscription. For example, the notification 124 might provide information to the subscriber 114 indicating why they were denied access to the subscription benefit 126. Other types of notifications 124 might also be provided. From operation 510, the routine 500 proceeds to operation 512, where it ends.

Figure 6:
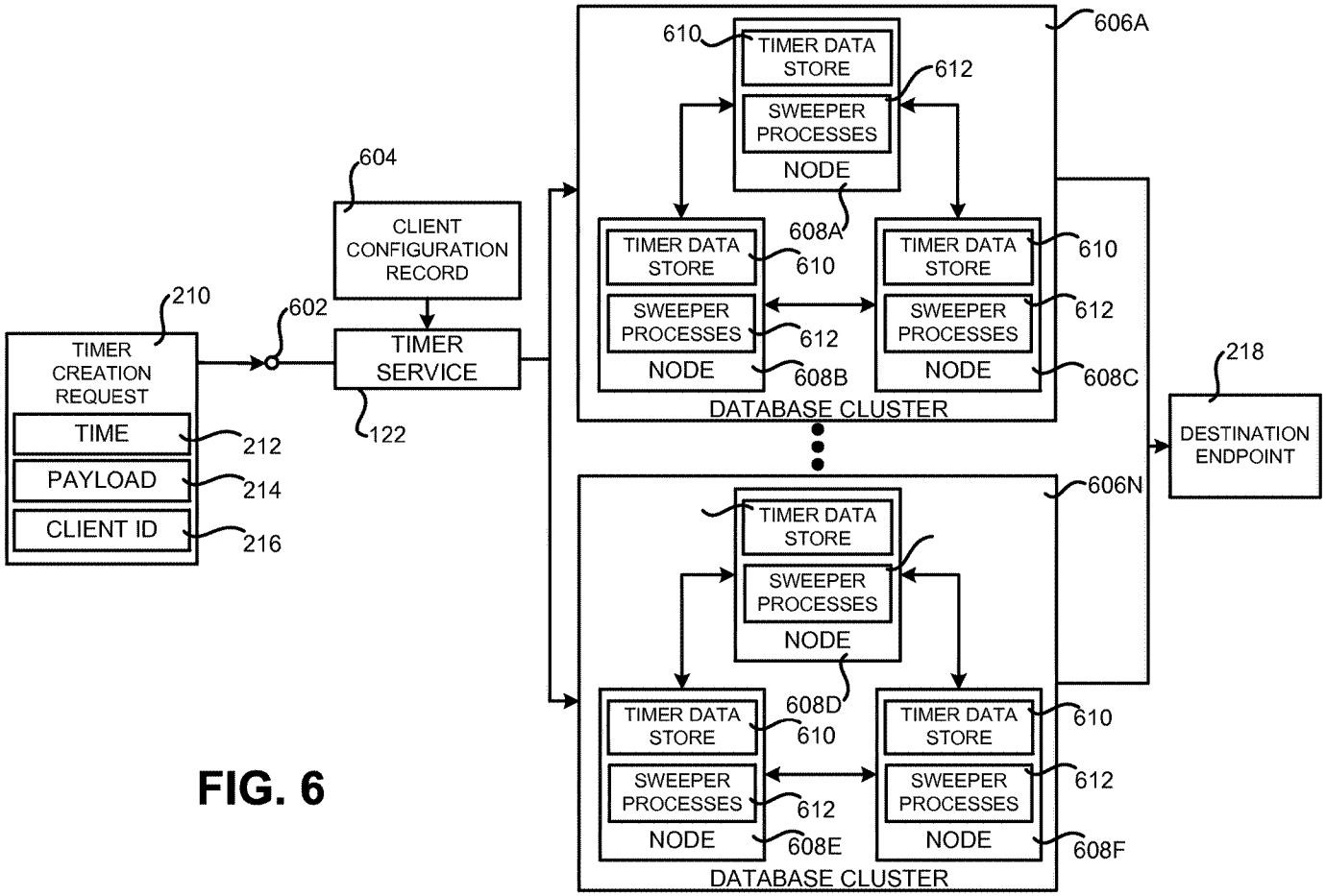
FIG. 6 is a software architecture diagram showing aspects of the configuration of a timer service utilized by the subscription management service to manage subscription periods, according to one embodiment disclosed herein.

FIG. 6 is a software architecture diagram showing aspects of the configuration of the timer service 122 that may be utilized by the subscription management service 118 to manage subscription periods in one embodiment disclosed herein. As discussed briefly above, the subscription management service 118 may utilize the timer service 122 to create timers that correspond to subscription events. Other clients might also utilize the timer service 122. When the timers expire, the timer service 122 may create notifications to the subscription management service 118 for the subscription events. The subscription management service 118 may then take various types of actions depending upon the type of subscription event identified by the expired timer.

Figure 7:
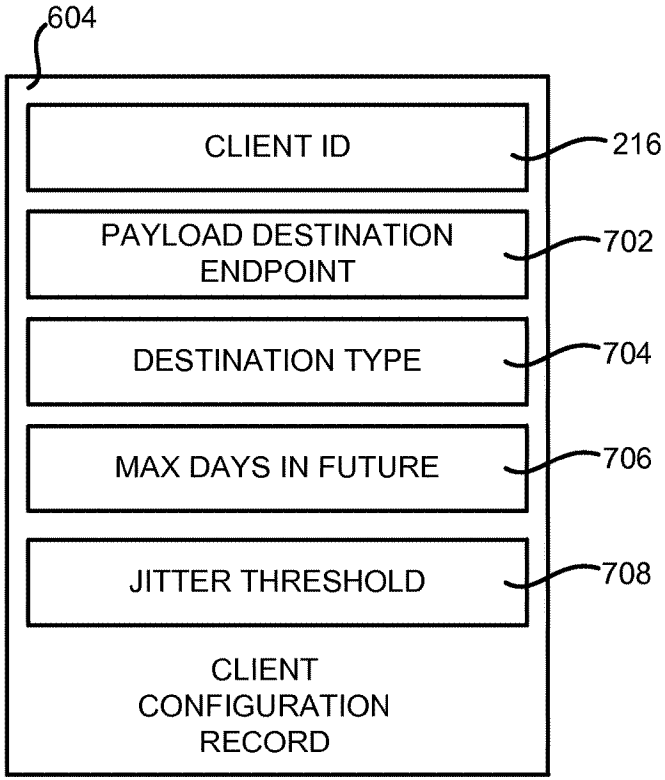
FIG. 7 is a data structure diagram showing aspects of a client configuration record utilized by the timer service, according to one embodiment disclosed herein.

In order to provide the functionality described above, the timer service 122 is configured in one implementation to maintain a client configuration record 604 for each of its clients, such as the subscription management service 118. The client configuration record 604 stores configuration parameters that are utilized when the timer service 122 processes timer creation requests from a client. In this regard, FIG. 7 is a data structure diagram showing aspects of a client configuration record 604 utilized by the timer service 122, according to one embodiment disclosed herein. As shown in FIG. 7, the client configuration record 604 might include a field 702 utilized to specify a payload destination endpoint 218 for the payloads 214 of timers set by the clients of the timer service 122. The client configuration record 604 might also include a field 704 that describes the type of the destination endpoint 218 identified in the field 702.

As shown in FIG. 7, the client configuration record 604 might also include a field 708 that specifies a jitter threshold for use in modifying the time 212 at which timers set by the client should expire. Details regarding the use of the jitter threshold are provided below. Each client configuration record 604 might also include fields storing other data such as, but not limited to, a client ID 216 that uniquely identifies each client, and a field 706 that stores data defining the maximum period of time in the future that a timer can be created for the client.

The timer service 122 might also expose an interface 602, such as a Web services API or another type of interface. Clients, such as the subscription management service 118, may utilize the interface 602 to create new timers and/or modify existing timers. For example, a client may transmit a timer creation request 210 to the interface 602.

As shown in FIG. 6 and described briefly above, the timer creation request 210 may include a payload 214 for the timer that includes arbitrary data. In the case of the subscription management service 118, for example, the payload 214 might specify details regarding a subscription event for future consumption by the subscription management service 118. The timer creation request 210 might also specify a time 212 at which the specified payload 214 is to be provided to the payload destination endpoint 218 specified in field 702 of the client configuration record 604 for the calling client. The timer creation request 210 might also specify the client ID 216 of the calling client. The client ID 216 might be utilized to identify the client configuration record 604 for the calling client, and for other purposes.

As mentioned above, the timer service 122 may utilize the jitter threshold specified in the field 708 of the client configuration record 604 for a calling client to modify the time 212 at which the payload 214 will be provided to the specified destination endpoint 218. The jitter threshold specifies a maximum amount of time after the time 212 specified in the timer creation request 210 that the payload 214 can be provided to the payload destination endpoint 218. The timer service 122 may modify the time 212 specified in the timer creation request 210 to create the scheduled time for the timer by selecting a random amount of time less than the jitter threshold, and adding the random amount of time to the time 212 specified in the timer creation request 210. The scheduled time is then used as the time at which the payload 214 should be provided to the specified destination endpoint 218. The jitter threshold can be utilized in this manner to help ensure that large numbers of timers do not expire at exactly the same time, while still meeting any timeliness requirements of the calling client.

Figure 8:
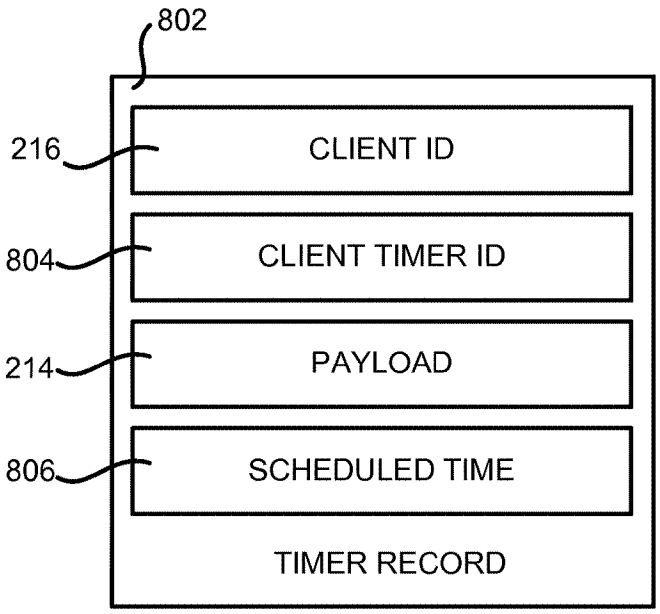
FIG. 8 is a data structure diagram showing aspects of a timer record utilized by the timer service, according to one embodiment disclosed herein.

Once the expiration time for a new timer creation request 210 has been modified using the specified jitter threshold, the timer service 122 creates the new timer using the scheduled time and the specified payload 214. In some implementations, the timer service 122 creates a timer record 802 (shown in FIG. 8) for the new timer in at least one of several database clusters 606A-606N. As shown in FIG. 8, the timer record 802 includes the scheduled time 806 and includes the payload 214. Each timer record 802 might also include other data, such as the unique client ID 216 mentioned above and a client timer ID 804 that uniquely identifies the timer.

As shown in FIG. 6, each database cluster 606 might include two or more nodes 608A-608F. Each of the nodes 608A-608F is a physical or virtual computing system configured to store a timer data store 610 containing timer records 802. Additionally, each database cluster 606 might be operated in a separate data center, preferably located in disparate geographical areas.

Each timer record 802 may be stored on at least two nodes 608A-608F in a database cluster 606 in some implementations. Sweeper processes 612 executing on each of the nodes 608 periodically evaluate the timer records 802 stored on the nodes 608 of each database cluster 606. A leader election mechanism (not shown) may be utilized to select one of the sweeper processes 612 in a given database cluster that will perform the firing of timers. If the active sweeper process becomes inactive for some reason, a new leader may be selected.

The timer service 122 then provides the payload 214 of each timer record 802 to the specified destination endpoint 218 at, or approximately at, the scheduled time 806 specified by the timer records 802. For example, and as described briefly above, the timer service 122 might place the payload of a timer record 802 on a distributed queue for consumption by the proper client, such as the subscription management service 122, at the appropriate time. Additional details regarding the configuration and operation of the timer service 122 will be provided below with regard to FIGS. 9-11.

Figure 9:
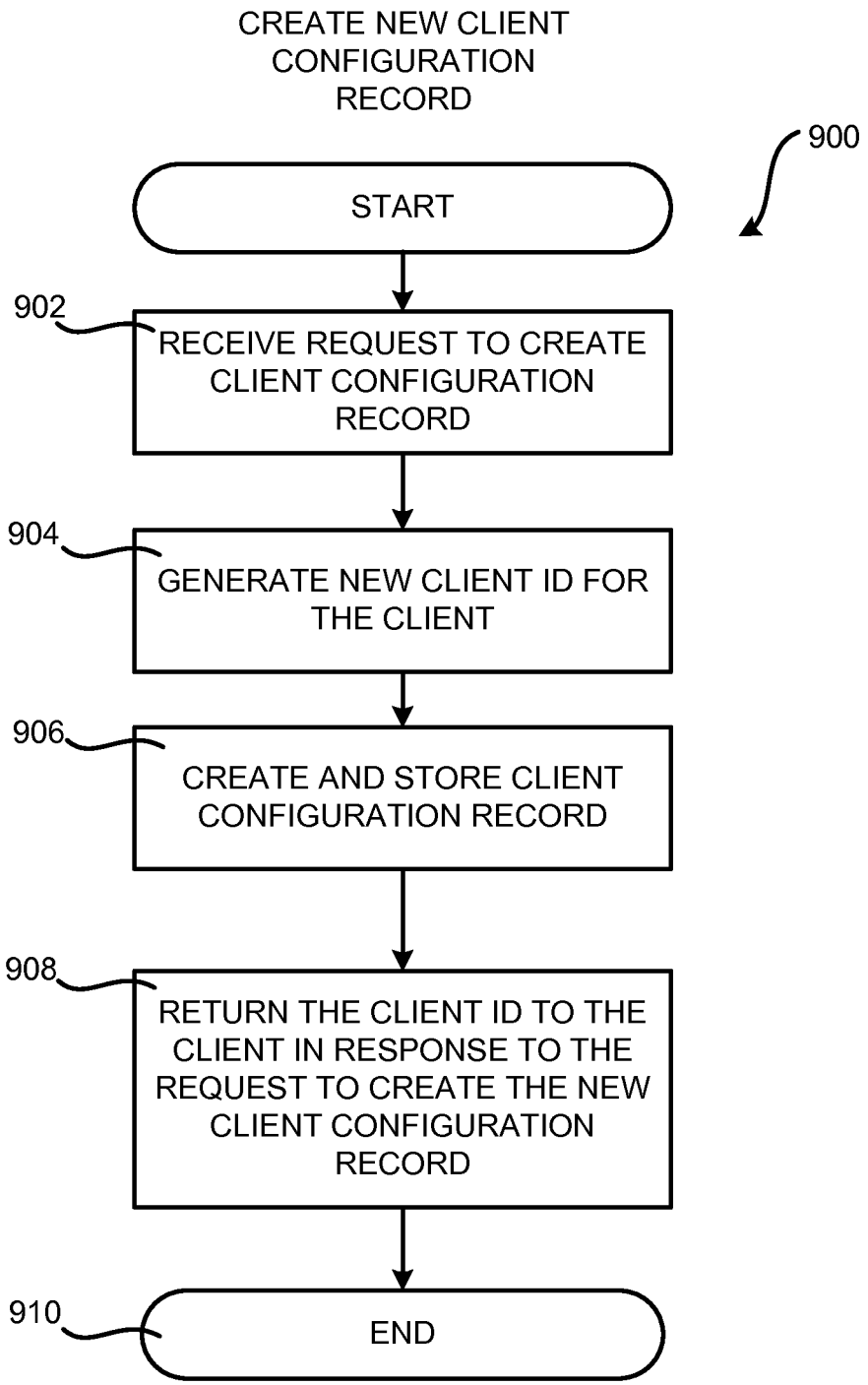
FIG. 9 is a flow diagram showing aspects of the operation of the timer service for creating a new client configuration record, according to one embodiment disclosed herein.

FIG. 9 is a flow diagram showing a routine 900 that illustrates aspects of the operation of the timer service 122 for creating a new client configuration record 604, according to one embodiment disclosed herein. The routine 900 begins at operation 902, where the timer service 122 receives a request to create a timer configuration record 604. In some embodiments, a client of the timer service 122 submits a client configuration record 604 including the data described above prior to submitting a timer creation request 210. The request to create a timer configuration record 604 might be received through the interface 602 or in another manner.

In response to receiving a request to create a new client configuration record 604, the routine 900 proceeds to operation 904 where the timer service 122 creates a new client ID 216 for the requesting client. The routine 900 then proceeds to operation 906, where the timer service 122 stores the new client configuration record 604, including the client ID 216, in an appropriate data store. The routine 900 then proceeds to operation 908, where the timer service 122 returns the client ID 216 to the requesting client in response to the request to create the client configuration record 604. As described above, clients of the timer service 122 typically submit the client ID 216 with timer creation requests 210. The client ID 216 might also be utilized for other purposes. From operation 908, the routine 900 proceeds to operation 910, where it ends.

Figure 10:
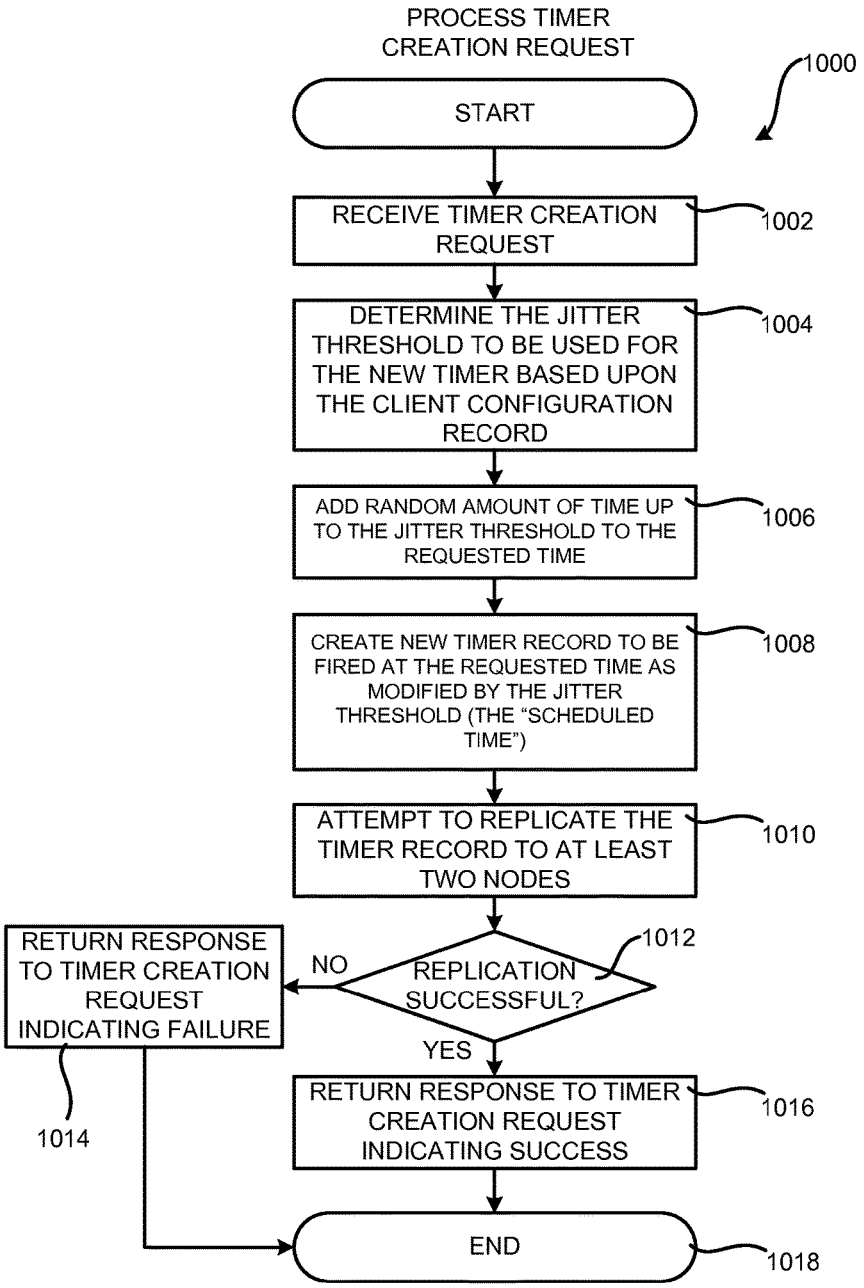
FIG. 10 is a flow diagram showing aspects of the operation of the timer service for processing a timer creation request, according to one embodiment disclosed herein.

FIG. 10 is a flow diagram showing a routine 1000 that illustrates aspects of the operation of the timer service 122 for processing a timer creation request 210, according to one embodiment disclosed herein. The routine 1000 begins at operation 1002, where the timer service 122 receives a timer creation request 210. In response to receiving the request 210, the routine 1000 proceeds from operation 1002 to operation 1004. At operation 1004, the timer service 122 determines the jitter threshold to be utilized to modify the time 212 specified in the timer creation request 210. In one embodiment, the timer service 122 identifies the jitter threshold by using the client ID 216 specified in the timer creation request 210 to locate the client configuration record 604 for the client that submitted the request 210. Other mechanisms might also be utilized to identify the jitter threshold. For example, in some embodiments the jitter threshold might be specified in the timer creation request 210. In this way, a different jitter threshold could be utilized for each timer.

From operation 1004, the routine 1000 proceeds to operation 1006, where the timer service 122 adds a random amount of time up to the specified jitter threshold to the time 212 specified in the timer creation request 210. In this way, the scheduled time 806 is computed that defines the time at which the new timer is to be fired. The routine 1000 then proceeds to operation 1008.

At operation 1008, the timer service 122 attempts to create a new timer record 802 on at least one of the database clusters 606A-606N. Additionally, at operation 1010, the timer service 122 attempts to replicate the new timer record 802 to at least two nodes 608 in one of the database clusters 606. If the replication of the new timer record 802 was not successful, the routine 1000 proceeds from operation 1012 to operation 1014, where the timer service 122 returns a reply to the timer creation request 210 indicating that the timer was not created successfully. If, however, the replication of the new timer record 802 was successful, the routine 1000 proceeds from operation 1012 to operation 1016, where the timer service 122 returns a reply to the timer creation request 210 indicating that the timer was created successfully. From operations 1014 and 1016, the routine 1000 proceeds to operation 1018, where it ends.

Figure 11:
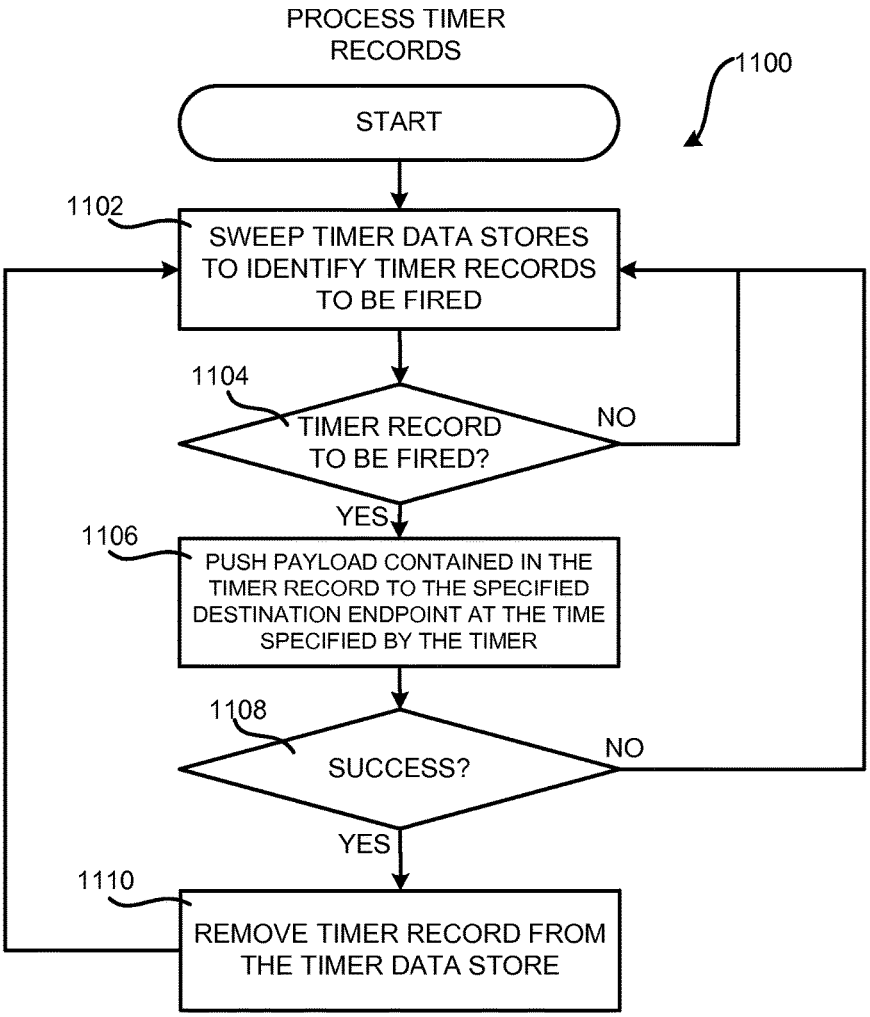
FIG. 11 is a flow diagram showing aspects of the operation of the timer service for processing timer records, according to one embodiment disclosed herein.

FIG. 11 is a flow diagram showing a routine 1100 that illustrates aspects of the operation of the timer service 122 for processing timer records, according to one embodiment disclosed herein. The routine 1100 begins at operation 1102, where the sweeper processes 612 executing on each node 608 sweep the timer data stores 610 to identify timer records 802 corresponding to timers that are about to expire (i.e. the scheduled time 806 is about to arrive). The routine 1100 then proceeds to operation 1104, where a determination is made as to whether any timer records 802 have been located that should be fired. If no timer records 802 have been located that are to be fired, the routine 1100 proceeds back to operation 1102, where the sweeping process continues.

If, at operation 1104, one or more timer records 802 are identified that correspond to timers that are to be fired, the routine 1100 proceeds to operation 1106. At operation 1106, the sweeper processes 612 cause the payloads 214 contained in the timer records 802 to be submitted to the destination endpoint 218 for each appropriate client. The payloads 214 are submitted to the destination endpoint 218 at, or approximately at, the scheduled time 806 specified in the timer records 802. Each client can then retrieve the payload 214 from the destination endpoint 218 and take appropriate action based on the contents of the payload 214.

From operation 1106, the routine 1100 proceeds to operation 1108, where a determination is made was to whether the payload 214 was successfully placed on the destination endpoint 218. If the payload 214 was not successfully placed on the destination endpoint 218, the corresponding timer record 802 is not removed from the timer data store 610. Rather, the routine 1100 proceeds back to operation 1102, where another attempt may be made to fire the timer. If the payload 214 is successfully placed on the destination endpoint 218, the routine 1100 proceeds from operation 1108 to operation 1110. At operation 1110, the timer record 802 is removed from the timer data store 610. The routine 1100 then proceeds back to operation 1102, where the process described above may be repeated to continually fire timers. It should be appreciated that other mechanisms might be utilized to fire the timers in other embodiments.

Figure 12:
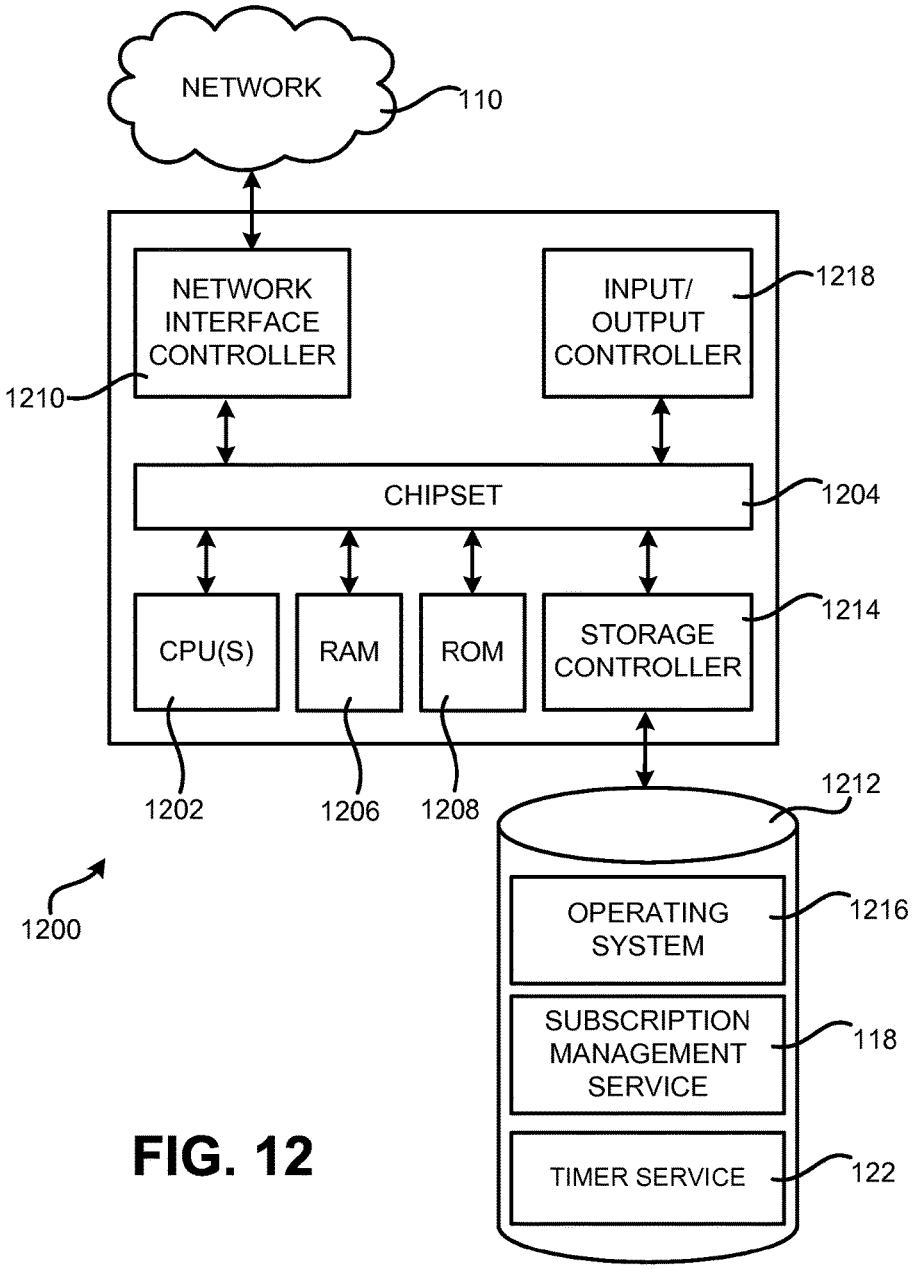
FIG. 12 is a computer architecture diagram showing one illustrative computer hardware architecture for use in computing devices configured to implement the concepts and technologies disclosed herein according to one embodiment.

FIG. 12 shows an example computer architecture for a computer 1200 capable of executing the software components described herein for providing services for managing subscriptions in the manner presented above. The computer architecture shown in FIG. 12 illustrates a conventional server computer, workstation, desktop computer, laptop, electronic book reader, digital wireless phone, tablet computer, network appliance, set-top box, or other computing device. The computer architecture shown in FIG. 12 may be utilized to execute any aspects of the software components presented herein described as executing on the application servers 104, the customer device 112, or any other computing platform.

The computer 1200 includes a baseboard, or "motherboard," which is a printed circuit board to which a multitude of components or devices may be connected by way of a system bus or other electrical communication paths. In one illustrative embodiment, one or more central processing units ("CPUs") 1202 operate in conjunction with a chipset 1204. The CPUs 1202 are standard programmable processors that perform arithmetic and logical operations necessary for the operation of the computer 1200.

The CPUs 1202 perform operations by transitioning from one discrete, physical state to the next through the manipulation of switching elements that differentiate between and change these states. Switching elements may generally include electronic circuits that maintain one of two binary states, such as flip-flops, and electronic circuits that provide an output state based on the logical combination of the states of one or more other switching elements, such as logic gates. These basic switching elements may be combined to create more complex logic circuits, including registers, adders-subtractors, arithmetic logic units, floating-point units, or the like.

The chipset 1204 provides an interface between the CPUs 1202 and the remainder of the components and devices on the baseboard. The chipset 1204 may provide an interface to a random access memory ("RAM") 1206, used as the main memory in the computer 1200. The chipset 1204 may further provide an interface to a computer-readable storage medium such as a read-only memory ("ROM") 1208 or non-volatile RAM ("NVRAM") for storing basic routines that that help to startup the computer 1200 and to transfer information between the various components and devices. The ROM 1208 or NVRAM may also store other software components necessary for the operation of the computer 1200 in accordance with the embodiments described herein.

According to various embodiments, the computer 1200 may operate in a networked environment using logical connections to remote computing devices and computer systems through a network, such as a local-area network ("LAN"), a wide-area network ("WAN"), the Internet, or any other networking topology known in the art that connects the computer 1200 to remote computers. The chipset 1204 includes functionality for providing network connectivity through a network interface controller ("NIC") 1210, such as a gigabit Ethernet adapter.

For example, the NIC 1210 may be capable of connecting the computer 1200 to other computing devices, such as the application servers 104, a data storage system in the merchant system 102, and the like, over the network 110 described above in regard to FIG. 1. It should be appreciated that multiple NICs 1210 may be present in the computer 1200, connecting the computer to other types of networks and remote computer systems.

The computer 1200 may be connected to a mass storage device 1212 that provides non-volatile storage for the computer. The mass storage device 1212 may store system programs, application programs, other program modules, and data, which have been described in greater detail herein. The mass storage device 1212 may be connected to the computer 1200 through a storage controller 1214 connected to the chipset 1204. The mass storage device 1212 may consist of one or more physical storage units. The storage controller 1214 may interface with the physical storage units through a serial attached SCSI ("SAS") interface, a serial advanced technology attachment ("SATA") interface, a FIBRE CHANNEL ("FC") interface, or other standard interface for physically connecting and transferring data between computers and physical storage devices.

The computer 1200 may store data on the mass storage device 1212 by transforming the physical state of the physical storage units to reflect the information being stored. The specific transformation of physical state may depend on various factors, in different implementations of this description. Examples of such factors may include, but are not limited to, the technology used to implement the physical storage units, whether the mass storage device 1212 is characterized as primary or secondary storage, or the like.

For example, the computer 1200 may store information to the mass storage device 1212 by issuing instructions through the storage controller 1214 to alter the magnetic characteristics of a particular location within a magnetic disk drive unit, the reflective or refractive characteristics of a particular location in an optical storage unit, or the electrical characteristics of a particular capacitor, transistor, or other discrete component in a solid-state storage unit. Other transformations of physical media are possible without departing from the scope and spirit of the present description, with the foregoing examples provided only to facilitate this description. The computer 1200 may further read information from the mass storage device 1212 by detecting the physical states or characteristics of one or more particular locations within the physical storage units.

In addition to the mass storage device 1212 described above, the computer 1200 might have access to other computer-readable media to store and retrieve information, such as program modules, data structures, or other data. It should be appreciated by those skilled in the art that computer-readable media can be any available media that may be accessed by the computer 1200, including computer-readable storage media and communications media. Communications media includes transitory signals. Computer-readable storage media includes volatile and non-volatile, removable and non-removable storage media implemented in any method or technology. For example, computer-readable storage media includes, but is not limited to, RAM, ROM, erasable programmable ROM ("EPROM"), electrically-erasable programmable ROM ("EEPROM"), flash memory or other solid-state memory technology, compact disc ROM ("CD-ROM"), digital versatile disk ("DVD"), high definition DVD ("HD-DVD"), BLU-RAY, or other optical storage, magnetic cassettes, magnetic tape, magnetic disk storage or other magnetic storage devices, or any other medium that can be used to store the desired information. Computer-readable storage media does not include transitory signals.

The mass storage device 1212 may store an operating system 1216 utilized to control the operation of the computer 1200. According to one embodiment, the operating system comprises the LINUX operating system. According to another embodiment, the operating system comprises the WINDOWS® SERVER operating system from MICROSOFT Corporation of Redmond, Washington. According to further embodiments, the operating system may comprise the UNIX or SOLARIS operating systems. It should be appreciated that other operating systems may also be utilized. The mass storage device 1212 may store other system or application programs and data utilized by the computer 1200. For instance, when utilized to implement the customer device 112, the mass storage device 1212 may store a client application, such as a Web browser application. When utilized to implement one or more of the application servers 104, the mass storage device 1212 may store the subscription management service 118 or the timer service 122. The mass storage device 1212 might also store any of the other program components and data described herein and, potentially, other types of program components and data.

In one embodiment, the mass storage device 1212 or other computer-readable storage media may be encoded with computer-executable instructions that, when loaded into the computer 1200, transform the computer from a general-purpose computing system into a special-purpose computer capable of implementing the embodiments described herein. These computer-executable instructions transform the computer 1200 by specifying how the CPUs 1202 transition between states, as described above. According to one embodiment, the computer 1200 has access to computer-readable storage media storing computer-executable instructions that, when executed by the computer, perform the various routines and operations described herein.

The computer 1200 may also include an input/output controller 1218 for receiving and processing input from a number of input devices, such as a keyboard, a mouse, a touchpad, a touch screen, an electronic stylus, or other type of input device. Similarly, the input/output controller 1218 may provide output to a display device, such as a computer monitor, a flat-panel display, a digital projector, a printer, a plotter, or other type of output device. It will be appreciated that the computer 1200 may not include all of the components shown in FIG. 12, may include other components that are not explicitly shown in FIG. 12, or may utilize an architecture completely different than that shown in FIG. 12.

Based on the foregoing, it should be appreciated that technologies for providing subscription management services have been presented herein. Although the subject matter presented herein has been described in language specific to computer structural features, methodological acts, and computer readable media, it is to be understood that the invention defined in the appended claims is not necessarily limited to the specific features, acts, or media described herein. Rather, the specific features, acts, and mediums are disclosed as example forms of implementing the claims.

The subject matter described above is provided by way of illustration only and should not be construed as limiting. Furthermore, the claimed subject matter is not limited to implementations that solve any or all disadvantages noted in any part of this disclosure. Various modifications and changes may be made to the subject matter described herein without following the example embodiments and applications illustrated and described, and without departing from the true spirit and scope of the present invention, which is set forth in the following claims.

What is claimed is:

1. A computer-implemented method for successively firing timers for clients of a timer service, the computer-implemented method comprising executing instructions in a computer system to perform the operations of:

exposing a Web services application programming interface (API) to the clients of the timer service, wherein the API exposes functionality for creating a timer for individual clients and the timer service is associated with a subscription service;

storing client configuration records for the clients, individual client configuration records specifying a payload destination and a jitter threshold for a respective client;

receiving, via one or more computers of the subscription service, a request from individual clients to create a timer via the Web services API, the request comprising a payload and specifying a time at which the payload is to be provided to the payload destination, the jitter threshold specifying a maximum amount of time after the time specified in the request that the payload can be provided to the payload destination;

modifying, via one or more computers of the timer service, the time specified in individual timer creation requests by selecting a random amount of time less than the jitter threshold and by adding the random amount of time to the time specified in the timer creation request for the respective client;

creating, via the one or more computers of the timer service, the timer for individual clients using the respective modified time and the payload; and providing, via the one or more computers of the timer service, individual payloads to the payload destination at approximately the respective modified time.

2. The computer-implemented method of claim 1, wherein creating the timer using the modified time and the payload comprises storing a timer record comprising the modified time and the payload in at least two nodes of a database cluster associated with the timer service.

3. The computer-implemented method of claim 2, wherein the payload destination comprises a distributed queue.

4. The computer-implemented method of claim 3, wherein the client configuration record and the timer record further comprise a client identifier that uniquely identifies the client.

5. The computer-implemented method of claim 2, wherein providing each payload to the payload destination comprises sweeping timer data stores within the at least two nodes of the database cluster to identify timer records about to expire.

6. A computer-readable storage medium having computer-executable instructions stored thereupon which, when executed by the computer, cause the computer to:

expose an interface for receiving requests to create new timers, wherein the interface is an application programming interface (API) that exposes functionality for creating the new timers and wherein the interface is utilized by subscription service clients to communicate with a subscription service that is associated with a timer service;

receive, by way of the interface, requests from clients to create new timers, individual requests comprising a payload and data identifying a time at which the payload is to be delivered to a destination;

modify, by one or more computers of the timer service, the time for the individual requests using a jitter threshold associated with the client, the jitter threshold specifying a maximum amount of time after the time that the payload can be provided to the destination, comprising:

select a random amount of time less than the jitter threshold; and add the random amount of time to the time at which the payload is to be delivered to the destination;

cause, by the one or more computers of the timer service, a new timer to be created by the timer service at the modified time for the individual clients; and deliver, by the one or more computers of the timer service, the payload for the individual clients to the destination at approximately the modified time.

7. The computer-readable storage medium of claim 6, wherein the API comprises a Web services application programming interface.

8. The computer-readable storage medium of claim 6, having further computer-executable instructions stored thereupon which, when executed by the computer, cause the computer to store a client configuration record for the client, the client configuration record comprising data identifying the destination and the jitter threshold.

9. The computer-readable storage medium of claim 8, wherein the client configuration record further specifies a type for the payload destination.

10. The computer-readable storage medium of claim 8, wherein the client configuration record further specifies a maximum period of time in the future that a timer can be created for the client.

11. The computer-readable storage medium of claim 8, wherein the client configuration record further specifies a unique client identifier for the client.

12. The computer-readable storage medium of claim 6, having further computer-executable instructions stored thereupon which, when executed by the computer, cause the apparatus to create a timer record on at least two nodes of a database cluster, the timer record comprising the modified time and the payload.

13. An apparatus configured to successively fire timers for clients of a timer service, the apparatus comprising:

at least one processor; and a computer-readable storage medium having computer-executable instructions stored thereon which, when executed on the at least one processor, cause the apparatus to receive requests, via an interface exposed by the timer service, to create timers, individual requests identifying a payload and a time at which the payload is to be delivered to a destination, wherein the interface is an application programming interface (API) that exposes functionality for creating the timers and wherein the interface is utilized by subscription service clients to communicate with a subscription service associated with the timer service;

in response to receiving the individual requests, modify, by one or more computers of the timer service, the time using a jitter threshold, the jitter threshold specifying a maximum period after the time that the payload can be provided to the destination, wherein the modification comprises:

select a random amount of time less than the jitter threshold, and add the random amount of time to the time at which the payload is to be delivered to the destination, cause, by the one or more computers of the timer service, a timer that expires at the modified time to be created by the timer service for the individual requests, and deliver, by the one or more computers of the timer service, the payload for the individual requests to the destination at approximately the respective modified time.

14. The apparatus of claim 13, wherein the computer-readable storage medium has further computer-executable instructions stored thereon which, when executed on the at least one processor, cause the apparatus to create a timer record on at least two nodes of a database cluster, the timer record comprising the modified time and the payload.

15. The computer-implemented method of claim 14, wherein deliver the payload for each request to the destination comprises sweeping timer data stores within the at least two nodes of the database cluster to identify timer records about to expire.

16. The apparatus of claim 13, wherein the destination comprises a queue.

17. The apparatus of claim 13, wherein the payload comprises data relating to a subscription event.

18. The apparatus of claim 13, wherein the apparatus is further configured to maintain a client configuration record for a client submitting the request, the client configuration record comprising data identifying the destination and the jitter threshold.

19. The apparatus of claim 18, wherein the client configuration record further specifies a destination type for the destination.

20. The apparatus of claim 19, wherein the client configuration record further specifies a maximum period of time in the future that a timer can be created for the client.

* * * * *